United States Patent [19]

Yamada

[11] Patent Number: 4,817,503

[45] Date of Patent: Apr. 4, 1989

[54] DIAPHRAGM PUMP WITH PRESSURE CHAMBER HAVING A RIBBED WALL

[75] Inventor: Kazumasa Yamada, Tokyo, Japan

[73] Assignee: Yamada Yuki Seizo Co., Ltd., Tokyo, Japan

[21] Appl. No.: 126,445

[22] Filed: Nov. 30, 1987

[30] Foreign Application Priority Data

Sep. 22, 1987 [JP] Japan ..... 62-237960

[51] Int. Cl.[4] ..... F04B 43/06

[52] U.S. Cl. ..... 92/98 R; 92/169.2; 417/393; 417/395

[58] Field of Search ..... 417/393, 395, 413; 92/169, 169.2, 98 R, 100; 123/193 H, 195 R, 195 A; 220/327, 328

[56] References Cited

U.S. PATENT DOCUMENTS

| | | | |
|---|---|---|---|
| 2,364,111 | 12/1944 | Tucker | 92/98 R X |
| 2,625,886 | 1/1953 | Browne | 417/393 X |
| 4,252,510 | 2/1981 | Bromley | 417/534 |
| 4,500,264 | 2/1985 | Lindner | 417/395 |

FOREIGN PATENT DOCUMENTS

| | | | |
|---|---|---|---|
| 1186562 | 5/1985 | Canada | 417/395 |

OTHER PUBLICATIONS

Sandpiper Air Powered Double Diaphragm Pumps; The Warren Rupp Company, Mansfield, Ohio 1981.

*Primary Examiner*—Leonard E. Smith
*Attorney, Agent, or Firm*—Biebel, French & Nauman

[57] ABSTRACT

A pressure chamber of a diaphragm pump having an outer chamber improved so that it is free from stress concentration. The inner wall surface of the pressure chamber is recessed in a mero-spherical shape. In order to support this chamber wall from its rear side, an outer ring rib is provided along the outermost periphery of the outer surface of the chamber, and an inner ring rib is circumferentially disposed at the inner side of the outer ring rib. Further, radial ribs are provided so as to connect together the outer and inner ring ribs in the radial direction.

1 Claim, 4 Drawing Sheets

DIAPHRAGM PUMP WITH PRESSURE CHAMBER HAVING A RIBBED WALL

BACKGROUND OF THE INVENTION

1. Field of the Invention

The present invention relates to a diaphragm pump, and more particularly, to a double-diaphragm pump which is suitably used to transport, transfer and recirculate a fluid such as a liquid, powder or glanular material.

2. Description of the Prior Art

In a typical conventional pressure chamber (pressure vessel or outer chamber) of a diaphragm pump, a domed outer chamber which has generally a uniform thickness is produced using a material such as aluminum, cast iron, engineering plastic, stainless steel, etc., and such an outer chamber is rigidly secured to the body of the pump to thereby define a material chamber for pumping a material such as a fluid or the like. The wall thickness of the shell portion of the outer chamber is substantially uniform throughout it as described above, and in order to enable the pressure chamber that serves as a pressure vessel to bear high pressure, it is conventional practice to uniformly increase the wall thickness of the shell portion to thereby enhance the pressure resistance. The shell portion thus formed may be deformed considerably by the constantly high pressure within the material chamber, or local stress concentration may be caused in the shell portion by rapid increase and decrease in pressure, and there is therefore a fear of the shell portion developing a small but dangerous crack. In order to overcome this problem, it has been attempted to reinforce the shell portion by providing radial ribs on its outer surface. However, in this prior art, the outer chamber and the diaphragm are rigidly secured to the body of the pump by fastening them together in one unit at the outer edge of the shell portion by means of bolts which are received through bores provided in the shell outer edge. Accordingly, that portion of the outer edge of the shell portion which is defined between each pair of adjacent fastened portions (i.e., the portion intermediate between each pair of adjacent bolt receiving bores) may be deflected (expanded outward) by high pressure, and this non-uniform deformation may cause leakage of a fluid from the outer edge of the shell portion.

In order to enhance the pressure resistance and prevent the local deformation, it is conventional practice to use an excessively large amount of a material for forming the outer chamber and considerably increase the weight of the pressure vessel or the overall weight of the pump. However, this practice goes against the tendency to reduce the amount of material used and the weight of the product. When the outer chamber is formed from an engineering plastic, the chamber may be formed with a more than enough wall thickness, but, since the heat capacity increases in proportion to the weight of the plastic used, if the chamber has a large wall thickness, a long time is required for the formed material to cool down. In addition, non-uniform cooling takes place in the shell portion, and this leads to small strains or deflections on the product, which may result in lowering in the pressure resistance and leakage resistance of the chamber. More specifically, when the outer chamber is produced from a thermoplastic material by a molding process, it has been demanded to minimize the amount of material used to thereby enable the formed material to cool down relatively quickly and to provide a structure which enables the applied pressure and the cooling rate to be made as uniform as possible throughout the shell portion and which imparts high pressure resistance to the product.

SUMMARY OF THE INVENTION

In view of these circumstances, it is a primary object of the present invention to solve at a stroke the above-described problems of the conventional diaphragm pumps, particularly the problems experienced when the outer chamber is produced from a material such as an engineering plastic, an aluminum alloy, cast iron, etc. and thus realize extension of the lifetime of a diaphragm pump, facilitation of maintenance, lowering in the production cost as a result of a reduction in the amount of material used, and a reduction in the weight of the product.

To this end, the present invention provides a pressure chamber of a diaphragm pump which is provided therein with a diaphragm, the pressure chamber comprising: an outer ring rib; an inner ring rib circumferentially extending at the inner side of the outer ring rib; and a radial rib extending so as to connect together the outer and inner ring ribs in the radial direction.

If a plurality of inner ring ribs are concentrically disposed at the inner side of the outer ring rib, it is possible to further increase the resistance to pressure and deformation of a large-sized pressure chamber. The wall thickness of the outer ring rib may be made larger than the circumferential wall thickness of the radial rib and the radial wall thickness of the inner ring rib. The outer ring rib may be provided with a plurality of fastening bores for receiving bolts or the like to fasten the diaphragm. Further, the wall surface of the pressure chamber which faces the diaphragm preferably has a mero-spherical surface. The mero-spherical wall surface of the pressure chamber defines a material chamber (the portion which is in contact with a fluid), and it is preferable to form a check valve or ball valve portion in the peripheral portion of the chamber such that the valve portion is communicated with the material chamber. That portion of the pressure chamber which is in contact with a fluid, including the ball valve portion, is made of or coated with a corrosion-resistant material selected from the group consisting of an aluminum alloy, polypropylene and Teflon.

When the pressure chamber of a diaphragm pump according to the present invention is viewed in a vertical cross-section, a chamber wall which has a substantially uniform wall thickness has a mero-spherical surface which defines a space serving as a material chamber, and this chamber wall is supported from its rear side by an outer ring rib which is disposed along the outermost periphery of the outer surface of the chamber wall and an inner ring rib which is circumferentially disposed at the inner side of the outer ring rib. Further, a plurality of radial ribs are extended on the outer surface of the chamber wall so as to connect together the outer and inner ring ribs in the radial direction, thereby combining the ribs in all directions to form a reinforcing structure which supports the curved chamber wall portion and the fastening peripheral portion defined by the peripheral edge of the curved surface. In operation of the diaphragm pump, when the pressure within the pressure chamber rises and the chamber wall is deformed in such a manner as to expand outward, force is applied to the inner ring rib and the peripheral edge of the chamber wall surface. However, deformation of the inner ring rib is firmly restrained by virtue of the circumferential deformation resistance of the inner ring rib itself and the radial deformation resistance of the radial ribs, and the deformation of the inner ring rib and the radial ribs is thus minimized. The remaining adrift displacement eventually reaches the outer ring rib. However, since the outer ring rib has the largest diameter and is made larger in wall thickness than the inner ring and radial ribs so that the strength of the outer ring rib is higher than that of the inner ring and radial ribs, the outer ring rib absorbs deformation of the inner ring and radial ribs with relatively small deformation. In this way, the deformation and stress caused by the pressure acting on the curved wall of the chamber are uniformly dispersed over the whole chamber wall, so that the deformation and stress are substantially uniformly supported by each portion of the chamber. Accordingly, no local stress concentration occurs in the chamber. This ensures a safe and stable operation of a diaphragm pump which continues a fluid transmitting motion under high-temperature and high-pressure conditions, e.g., generally, 100° to 200° C. and 7 to 10 kg/cm$^2$.

The above and other objects, features and advantages of the present invention will become clear from the following description of the preferred embodiment thereof, taken in conjunction with the accompanying drawings.

BRIEF DESCRIPTION OF THE DRAWINGS

The accompanying drawings show in combination a pressure chamber of a double-diaphragm pump in accordance with one embodiment of the present invention, in which.

DESCRIPTION OF THE PREFERRED EMBODIMENT

The arrangement of a pressure chamber of a double-diaphragm pump in accordance with one embodiment of the present invention will be described hereinunder in detail with reference to FIGS. 1 to 5.

Figure 1:
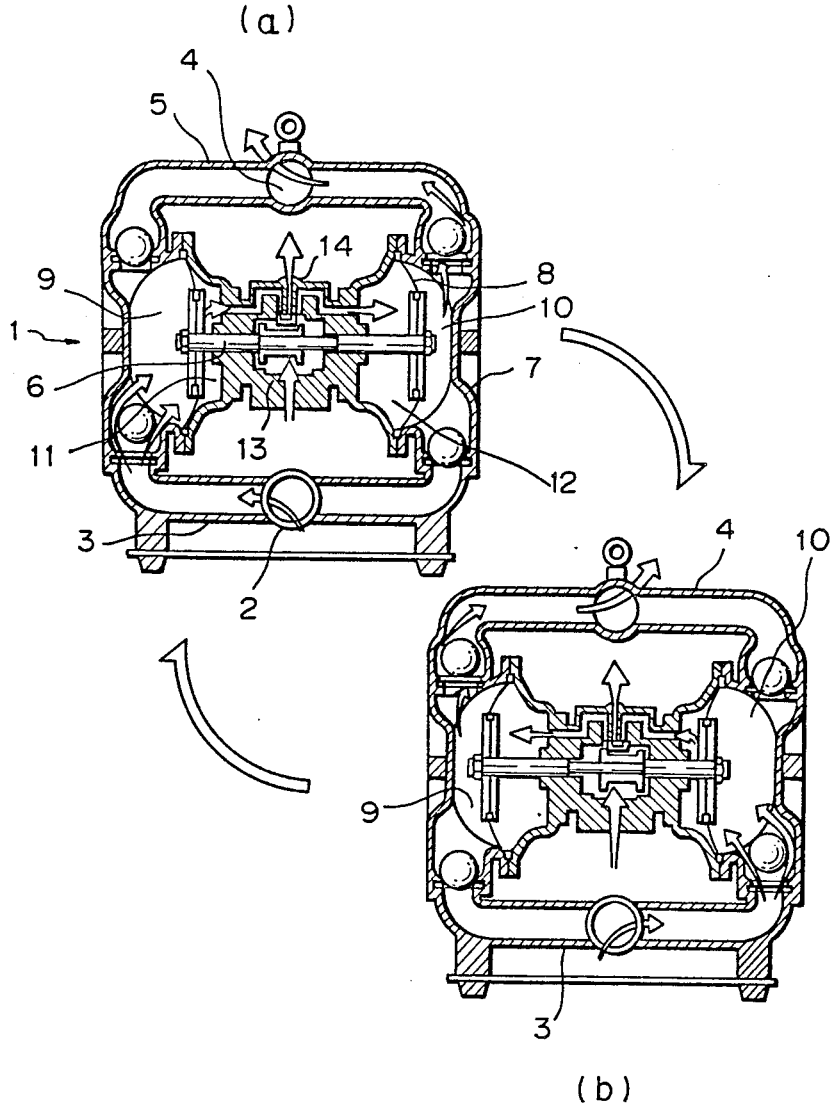
FIGS. 1(*a*) and 1(*b*) are schematic sectional front views employed to describe the operating principle of the double-diaphragm pump.

Referring first to FIGS. 1(*a*) and 1(*b*), which illustrate the operating principle of a double-diaphragm pump, two diaphragms 8 are secured to two axial ends, respectively, of a center rod 6, so that materials (fluids) in respective material chambers A 9 and B 10 are pumped in response to horizontal movement and deflection of the diaphragms 8. As shown in FIG. 1(*a*), when compressed air is supplied to an air chamber b 12 through an air supply port 13, the center rod 6 is moved rightward as viewed in the figure, and the material in the material chamber B 10 is thereby forced out and discharged from a material discharge port 4 through a ball valve portion 15 and an outer manifold 5. At the same time, a fresh material is sucked into the material chamber A 9 through a material suction port 2 and an inner manifold 3. When the center rod 6 reaches the right-hand extremity of its stroke, the position of an air switching valve is changed so that the compressed air is supplied to a left-hand air chamber a 11 [see FIG. 1(*b*)]. As a result, the center rod 6 is moved leftward, and the material in the material chamber A 9 is thereby forced out. At the same time, a fresh material is sucked into the righthand material chamber B 10 through the inner manifold 3. By repeating this operation, the material is continuously sucked and discharged, and thus it is possible to transport or transfer a material such as a liquid, powder or granular material simply by changing over the positions of the air switching valve from one to the other.

Figure 2:
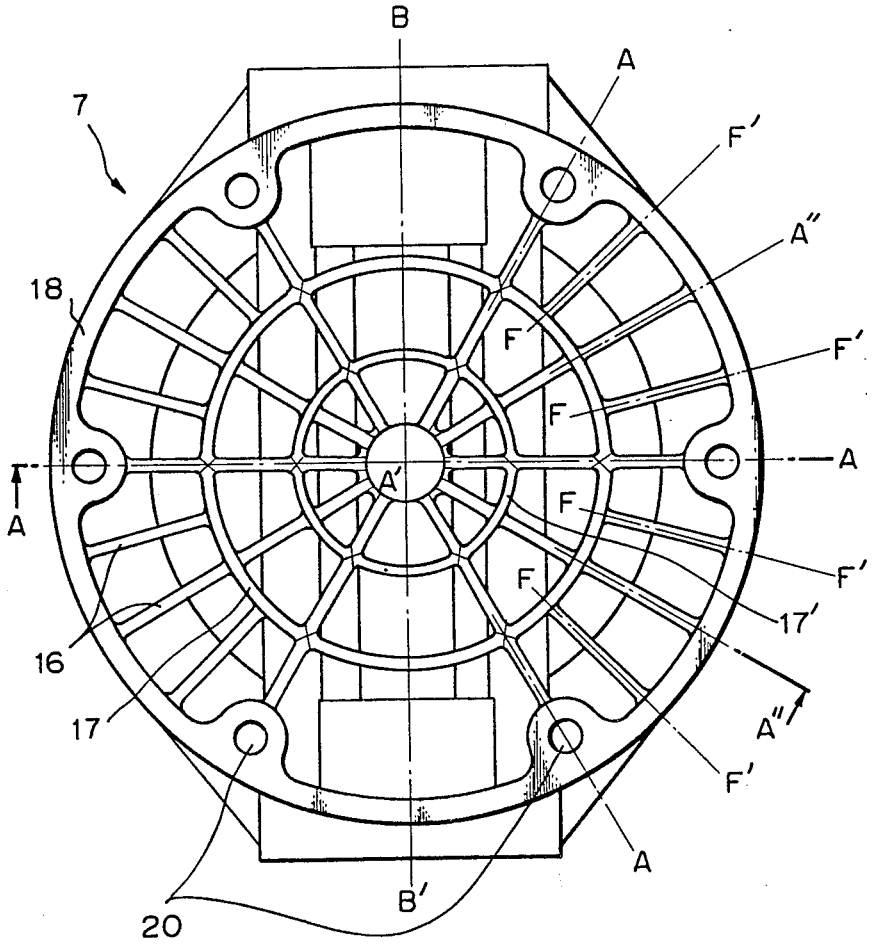
FIG. 2 is a plan view of the outer surface of an outer chamber constituting the pressure chamber.
Figure 3:
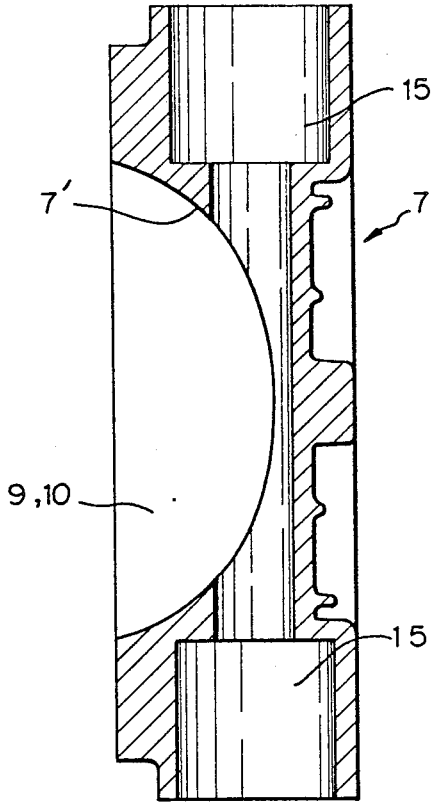
FIG. 3 is a sectional view taken along the line B—B′ of FIG. 2.
Figure 4:
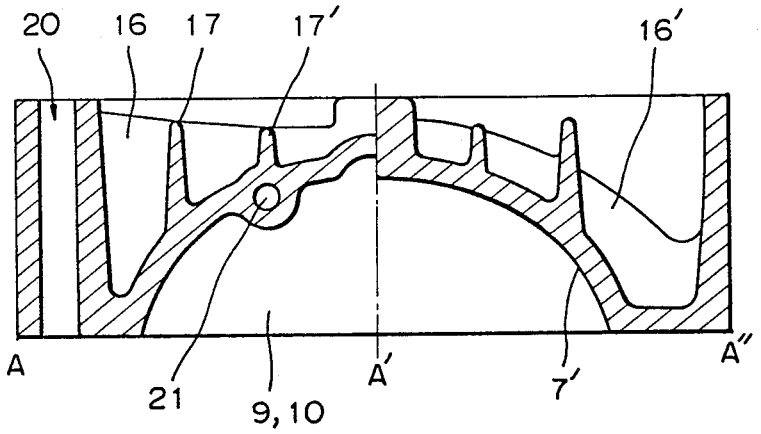
FIG. 4 is a sectional view taken along the line A—A′A″ of FIG. 2.
Figure 5:
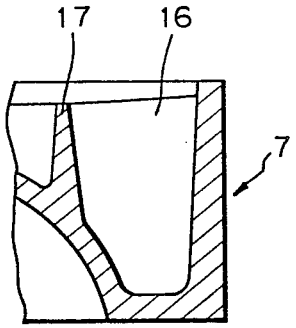
FIG. 5 is a sectional view taken along the line F—F′ of FIG. 2.

As clearly shown in FIG. 3, which is a vertical sectional view, the outer chamber 7 that constitutes the pressure chamber has a central mero-spherical wall surface 7′ which defines the material chamber 9 (10), and check valve portions 15 are disposed in close proximity and communication with the material chamber 9 (10). As will be clear from FIGS. 2, 4 and 5, the outer surface of the outer chamber 7 is provided with an outer ring rib 18 extending along its outer most peripheral edge, inner ring ribs 17, 17′ disposed at the inner side thereof, and radial ribs 16, 16′ extending so as to connect together the outer ring rib 18 and the inner ring ribs 17, 17′.

A plurality of fastening bores 20 are provided in the outer ring rib 18 so as to be spaced apart from each other circumferentially, the bores 20 being used to fasten and support the diaphragms 8 and also to secure the rib 18 itself to the body of the pressure chamber. Further, a fastening bore 21 is provided in the wall of the outer chamber 7 to secure the pressure chamber to the body of the pump by means of a securing member such as a bolt which is received in the bore 21 so as to extend through the pressure chamber in a direction perpendicular to the direction in which pressure acts.

As will be clear from FIG. 2, the inner ring ribs 17, 17′ and the radial ribs 16, 16′, which are disposed on the outer surface of the outer chamber 7, extend so as to cross each other in a cobweb shape and are connected to the outer ring rib 18 in one unit.

Thus, in the pressure chamber according to the present invention, deformation of the chamber wall caused by the fluid pressure acting on the inner wall surface of the chamber and stress resulting therefrom are effectively borne by an integral reinforcing structure consisting of the inner and outer ring ribs and the radial ribs which cross them, thereby enabling the deformation and stress to be substantially uniformly dispersed over the whole body of the outer chamber. Accordingly, the present invention exhibits the following advantages which have heretofore been unattainable with the conventional diaphragm pumps:

(1) It is possible to increase the pressure resistance of the pressure chamber by a large margin.

(2) The amount of material used to form the outer chamber is reduced, so that it is possible to form a larger outer chamber by using the same amount of chamber constituting material.

(3) When the outer chamber is formed using an engineering plastic, it is possible to make uniform the wall thickness of the chamber and therefore facilitate the formation of the outer chamber by a molding process. In general, when the wall of the outer chamber is thick, air bubbles are unable to escape from the material when being cooled, and this often leads to problems such as a lowering in strength of the portion trapping air bubbles or generation of leakage spots. However, the outer chamber in the present invention has generally a relatively thin wall. Therefore, the composition of each part of the chamber is stabilized and it is possible to avoid the above-described problems.

(4) The reduction in the amount of the material used enables realization of a reduction in the weight of the product and a lowering in the production cost.

(5) It is possible to markedly enhance the pressure resistance and leakage resistance of the pressure chamber and extend its lifetime.

Although the present invention has been described above through specific terms, it should be noted here that the described embodiment is not necessarily exclusive and various changes and modifications may be imparted thereto without departing from the scope of the invention which is limited solely by the appended claims.

What is claimed is:

1. A pressure chamber of a diaphragm pump which is provided therein with a diaphragm, said pressure chamber comprising:

a wall forming part of said pressure chamber with said wall having ribs thereon including an outer ring rib;

an inner ring rib circumferentially extending at the inner side of said outer ring rib; and a radial rib extending so as to connect together said outer and inner ring ribs in the radial direction, the circumferential wall thickness of said radial rib being substantially smaller than the radial wall thickness of said outer ring rib.

* * * * *